US005806471A

United States Patent [19]

Lin

[11] Patent Number: 5,806,471

[45] Date of Patent: Sep. 15, 1998

[54] STRUCTURE OF MULTI-STEP ENGINE AIR INTAKE VOLUME CONTROL DEVICE

[76] Inventor: Jung-Chih Lin, No. 48, Sec. 2, Kan-Yuan St., Shulin Town, Taipei County, Taiwan

[21] Appl. No.: 951,323

[22] Filed: Oct. 16, 1997

[51] Int. Cl.[6] ..... F02B 47/02

[52] U.S. Cl. ..... 123/25 A; 123/25 E

[58] Field of Search ..... 123/25 R, 25 A, 123/25 E

[56] References Cited

U.S. PATENT DOCUMENTS

| | | | |
|---|---|---|---|
| 4,391,230 | 7/1983 | Pesce et al. | 123/25 E |
| 4,397,268 | 8/1983 | Brown | 123/25 R |
| 4,403,944 | 9/1983 | Pyykkonen | 123/25 E |
| 4,589,376 | 5/1986 | Albertson | 123/25 E |
| 4,597,671 | 7/1986 | Marelli | 123/25 E |
| 4,800,848 | 1/1989 | Hubbard | 123/25 E |
| 5,199,386 | 4/1993 | Hubbard | 123/25 E |
| 5,694,908 | 12/1997 | Hsu | 123/25 E |

*Primary Examiner*—Erick R. Solis
*Attorney, Agent, or Firm*—Rosenberg, Klein & Bilker

[57] ABSTRACT

A multi-step engine air intake volume control device having a first electromagnetic valve connected between an air input port and a manifold pipe in a positive crankcase ventilating system of a motor vehicle and controlled by a control circuit to let fresh air be drawn into the engine of the motor vehicle subject to the revolving speed of the engine, wherein a container is mounted inside the motor vehicle, having a water chamber holding a volume of water and an oil chamber holding an oil; a second electromagnetic valve is provided having an input end connected to the water chamber and oil chamber of the container by a guide tube and three-way pipe connector assembly and an output end connected to the manifold pipe, the second electromagnetic valve being controlled by the control circuit to open the passage between the container and the manifold pipe for permitting water and oil mixture to be drawn from the container into the manifold pipe when air is guided by the manifold pipe into the engine of the motor vehicle.

2 Claims, 1 Drawing Sheet

STRUCTURE OF MULTI-STEP ENGINE AIR INTAKE VOLUME CONTROL DEVICE

BACKGROUND OF THE INVENTION

The present invention relates to an improved structure of multi-step engine air intake volume control device which provides fresh air and a water/oil mixture to the engine subject to the revolving speed of the engine.

U.S. Pat. No. 5,531,207, entitled "Multi-step engine air intake volume control device", teaches an installation of a control circuit and a set of electromagnetic valves in a positive crankcase ventilating system of a motor vehicle. The control circuit is connected to the speedometer of the motor vehicle and controlled to alternatively close/open the electromagnetic valves subject to the revolving speed of the engine, so that engine air intake volume is automatically regulated. The design simply automatically regulate the air intake volume of the engine.

SUMMARY OF THE INVENTION

The invention provides a water/oil mixture to the engine at a rate corresponding to the air intake volume of the engine, so as to improve the combustion rate of the engine. According to the preferred embodiment of the present invention, the multi-step engine air intake volume control device comprises a casing mounted inside a motor vehicle, the casing having an air input port and an air output port, an air filter element to filter air passing from the air input port to the air output port, a guide tube connected to the air output port of the casing, an electromagnetic valve controlled to open/close the guide tube, a manifold pipe installed in a positive crankcase ventilating system of the motor vehicle to guide air from the guide tube into the engine of the motor vehicle, and a control circuit connected to the speedometer of the motor vehicle and controlled to close/open the electromagnetic valve subject to the revolving speed of the engine, wherein a container is mounted inside the motor vehicle, having a water chamber holding a volume of water and an oil chamber holding an oil; a second electromagnetic valve is mounted inside the casing, having an input end connected to the water chamber and the oil chamber of the container by a guide tube and three-way pipe connector assembly and an output end connected to the manifold pipe, the second electromagnetic valve being controlled by the control circuit to open the passage between said container and the manifold pipe for permitting water and oil mixture to be drawn from the container into the manifold pipe when air is guided by the manifold pipe from the air output port of the casing into the engine of the motor vehicle.

DETAILED DESCRIPTION OF THE PREFERRED EMBODIMENT

Figure 1:
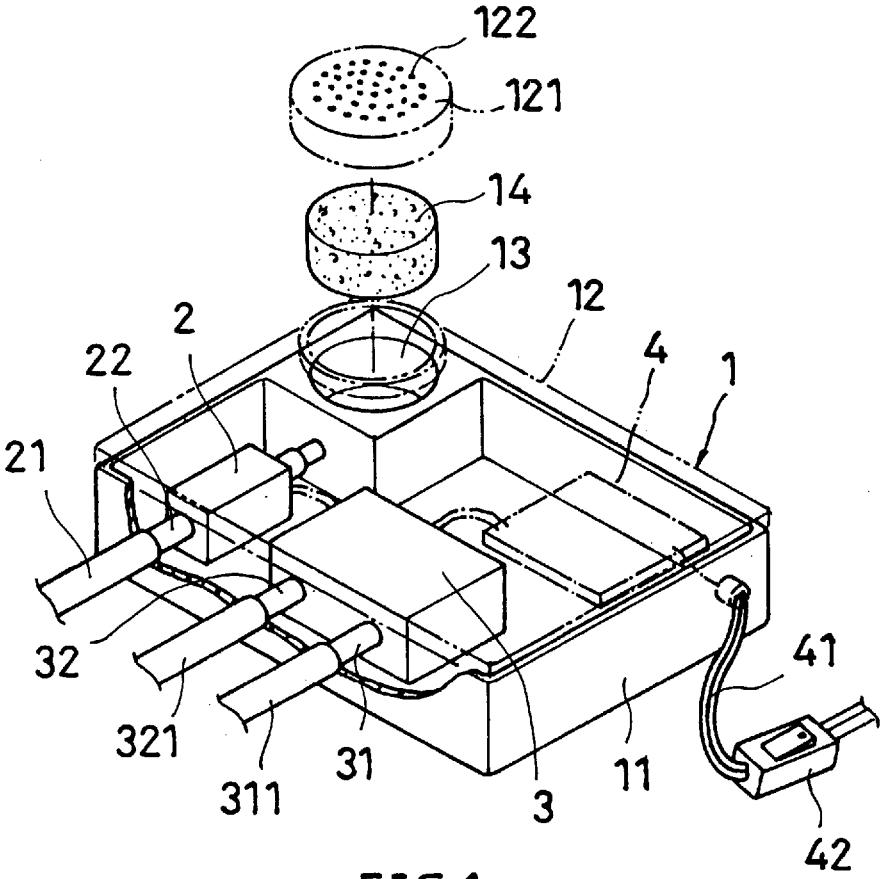
FIG. 1 is a perspective exploded view of a part of the present invention, showing the internal arrangement of the casing.
Figure 2:
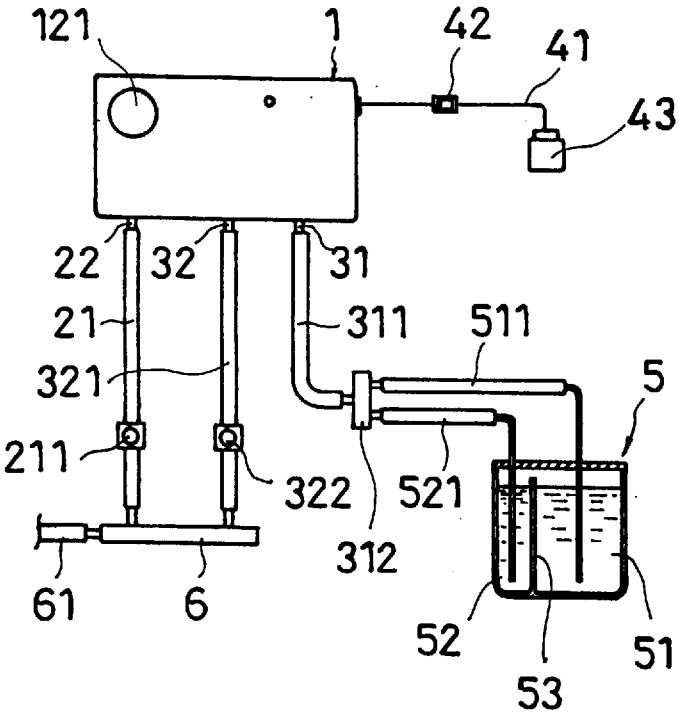
FIG. 2 is a plain view of the whole system of the present invention.

Referring to FIGS. 1 and 2, the casing, referenced by 1, comprises a bottom shell 11, and a cover shell 12 covered on the bottom shell 11. The bottom shell 11 comprises an air input port 13. An air filter element 14 is mounted in the air input port 13. A cap 121 is covered on the air input port 13 to hold down the air filter element 14. The cap 121 has a plurality of air vents 122. A control circuit board 4 is mounted inside the bottom shell 11. A first electromagnetic valve 2 is controlled by the control circuit board 4 to close/open the air input port 13. A second electromagnetic valve 3 is mounted inside the bottom shell 11. The electromagnetic valve 3 has an input end 31, and an output end 32. The input end 31 of the second electromagnetic valve 3 is connected to a container 5 outside the casing 1 by a connecting tube 311. The container 5 is separated by a partition board 53 into a water chamber 51 which holds water, and an oil chamber 52 which holds an oil. The connecting tube 311 has one end connected to the input end 31 of the second electromagnetic valve 3, and an opposite end connected to one end of a three-way pipe connector 312. The other two ends of the three-way pipe connector 312 are respectively connected to the water chamber 51 and oil chamber 52 by two guide tubes 511;521. The output end 32 of the second electromagnetic valve 3 and the output end, referenced by 22, of the first electromagnetic valve 2 are respectively connected to a manifold pipe 6 by guide tubes 321;21. The manifold pipe 6 is connected to the positive crankcase ventilating system 61 of a motor vehicle for guiding air into the engine of the motor vehicle. Two regulating valves 322;211 are respectively installed in the guide tubes 321;21 for regulating the flow of air or fluid mixture passing through. The control circuit board 4 is connected to the car battery 43 of the motor vehicle by an electrical cable 41, and connected to the speedometer of the motor vehicle. An On/Off switch 42 is installed in the electrical cable 41 for power On/Off control. The control circuit board 4 is controlled to close/open the electromagnetic valves 2;3 subject to the revolving speed of the engine.

When the motor vehicle is in operation and the switch 42 is switched on, the control circuit board 4 closes/opens the electromagnetic valves 2;3 subject to the revolving speed of the engine. When the electromagnetic valves 2;3 are opened, air and water/oil mixture are respectively drawn from the guide tubes 21;321 into the engine of the motor vehicle by a vacuum suction force, so that the combustion rate of the engine is greatly improved.

While only one embodiment of the present invention has been shown and described, it will be understood that various modifications and changes could be made thereunto without departing from the spirit and scope of the invention disclosed.

What the invention claimed is:

1. A multi-step engine air intake volume control device comprising a casing mounted inside a motor vehicle, said casing having an air input port and an air output port, an air filter element to filter air passing from said air input port to said air output port, a guide tube connected to said air output port of said casing, an electromagnetic valve controlled to open/close said guide tube, a manifold pipe installed in a positive crankcase ventilating system of said motor vehicle to guide air from said guide tube into the engine of said motor vehicle, and a control circuit connected to the speedometer of said motor vehicle and controlled to close/open said electromagnetic valve subject to the revolving speed of the engine, wherein a container is mounted inside said motor vehicle, having a water chamber holding a volume of water and an oil chamber holding an oil; a second electromagnetic valve is mounted inside said casing, having an input end connected to said water chamber and said oil chamber of said container by a guide tube and three-way pipe connector assembly and an output end connected to said manifold pipe, said second electromagnetic valve being controlled by said control circuit to open the passage between said container and said manifold pipe for permitting water and said oil to be drawn from said container into said manifold pipe when air is guided by said manifold pipe from said air output port of said casing into the engine of said motor vehicle.

2. The multi-step engine air intake volume control device of claim 1 further comprising a first flow rate control means adapted to regulate the flow rate of air passing from said air output port of said casing into said manifold pipe, and a second flow rate control means adapted to regulate the flow rate of water/oil mixture passing from said second electromagnetic valve into said manifold pipe.

* * * * *